United States Patent [19]

Wilson

[11] 4,057,246

[45] Nov. 8, 1977

[54] MULTIPURPOSE PUSH PULL EXERCISER

[76] Inventor: Bradford W. Wilson, 1642-A Coriander, Costa Mesa, Calif. 92626

[21] Appl. No.: 666,925

[22] Filed: Mar. 15, 1976

[51] Int. Cl.[2] ..... A63B 21/00

[52] U.S. Cl. ..... 272/137; 272/142; 272/143

[58] Field of Search ..... 272/137, 139, 142, 143, 272/75, 133, 116, 126; 63/5 A, 11; 124/91

[56] References Cited

U.S. PATENT DOCUMENTS

| | | | |
|---|---|---|---|
| 1,533,996 | 4/1925 | Olson | 63/5 A |
| 3,375,815 | 4/1968 | Novak | 124/91 X |
| 3,401,932 | 9/1968 | Schweitzer | 272/75 |

FOREIGN PATENT DOCUMENTS

| | | | |
|---|---|---|---|
| 831,305 | 5/1938 | France | 272/137 |
| 449,168 | 9/1927 | Germany | 272/142 |
| 1,052,620 | 12/1966 | United Kingdom | 272/142 |

*Primary Examiner*—Richard C. Pinkham
*Assistant Examiner*—William R. Browne
*Attorney, Agent, or Firm*—Gordon L. Peterson

[57] ABSTRACT

A multi-purpose exerciser comprising first and second elongated flexible elements and a tube having a passage extending therethrough. The first and second elongated flexible elements extend through the passage of the tube. The first elongated flexible element includes first and second elongated flexible segments projecting from opposite ends of the passage of the tube, and the second elongated flexible element includes third and fourth elongated flexible segments projecting from opposite ends of the passage of the tube. Each of the elongated flexible segments has an outer end remote from the tube. Handles are provided on each of the elongated flexible segments adjacent each of the outer ends thereof. The tube is of sufficient length to be grasped by a user during an exercise. The tube holds the elongated flexible elements together for the complete length of the tube.

9 Claims, 5 Drawing Figures

MULTIPURPOSE PUSH PULL EXERCISER

BACKGROUND OF THE INVENTION

Exercise devices for exercising both the arms and legs are known. One such device includes four elongated, resilient, flexible segments which are interconnected and which have handles at their outer ends. Two of the handles form stirrups for receiving the feet of the user, and the other two handles can be manually grasped. In use the arms and legs can work against the resilience of the associated flexible segments. Devices of this general nature are shown by way of example in U.S. Pat. Ser. Nos. 650,656, 843,478, and 866,495.

Exercise devices which include two elongated flexible resilient segments attached to a rigid bar are also known. However, these devices are less versatile than the exercise devices having four flexible segments.

SUMMARY OF THE INVENTION

The present invention provides a multi-purpose exerciser which greatly increases the number and kind of exercises which can be performed. This is accomplished by attaching four elongated flexible segments to an elongated member such as a tube. The tube is preferably at least substantially rigid. The tube forms a bar which can be gripped with one or both hands, pushed against with one or both feet, and placed against or behind various abutments thereby materially increasing the number and kind of exercises which can be performed with the exerciser.

The four elongated flexible segments can be independent, discrete segments appropriately attached to the tube, if desired. However, the present invention obtains substantial additional advantages by utilizing first and second elongated flexible elements or cords and passing the cords through the tube to define two of the elongated flexible segments.

With this construction, the tube serves not only to make the exerciser useful in performing a large number of exercises, but it also serves to attach, or assist in attaching, the two cords together. In addition, the tube effectively divides each of the cords into two elongated flexible, resilient segments, and provides a neat appearance. The tube has no rough edges which could injure the user, and it strongly holds the two cords together.

In a preferred construction, means are provided for attaching the cords together adjacent central regions thereof. Such attachment means, in addition to the tube, may also include a separate attaching device such as a clamp which can be located within the tube. The tube conceals the clamp and prevents the clamp from scratching or otherwise injuring the user.

The tube is preferrably centered on the cords. Means are provided for frictionally resisting the sliding of the tube along the cords. Although such means may take differing forms, this can be accomplished by providing cords of large enough cross-sectional area so that they fit snugly within the passage of the tube.

In order to adapt the multi-purpose exerciser for use in both arm and leg exercises, two of the elongated flexible segments are preferably longer than the other two flexible segments. An additional advantage of this construction is that when only two of the flexible segments are used, the user can select the two which best fit his stature and exercise requirements.

The invention, together with further features and advantages thereof, may best be understood by reference to the following description taken in connection with the accompanying illustrative drawing.

DESCRIPTION OF THE PREFERRED EMBODIMENT

Figure 1:
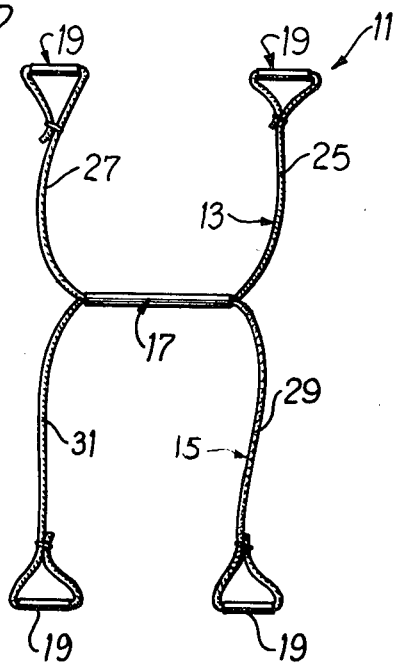
FIG. 1 is an elevational view of a multi-purpose exerciser constructed in accordance with the teachings of this invention.

FIG. 1 shows a multi-purpose exerciser 11 which comprises first and second elongated, flexible elements in the form of cords 13 and 15, a tube 17 and four identical handles 19. Each of the cords 13 and 15 is constructed of a suitable strong, resilient material. Although the cords 13 and 15 can be of various lengths, in the embodiment illustrated, the cord 13 is shorter than the cord 15.

The tube 17 is preferably rigid and may be constructed from plastic or a metal such as aluminum. In the embodiment illustrated, the tube 17 is constructed of a rigid plastic material and has a smooth cylindrical outer surface 21. The tube 17 has an axial cylindrical passage 23 which extends completely therethrough.

Figure 2:
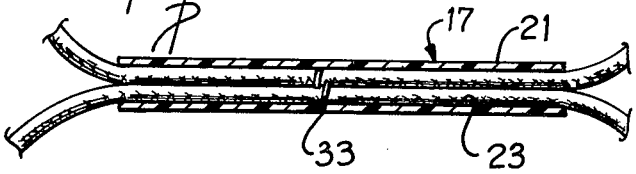
FIG. 2 is an enlarged, fragmentary, section view of the tube taken on an axial plane.

Although the cords 13 and 15 can be attached to the tube 17 in various different ways, in the embodiment illustrated, both of these cords extend through the passage 23 as shown in FIGS. 1 and 2. It is desirable to prevent or retard slipping of the tube 21 over the cords 13 and 15. Although this can be accomplished in many different ways, in the embodiment illustrated, the diameters of the cords 13 and 15 are sufficiently large so as to cause the cords to fit tightly within the passage 23. In this manner, the tube 17 is frictionally retained against sliding movement along the cords 13 and 15.

The tube 17 is preferably positioned at central regions of the cords 13 and 15. The tube 17 divides the cord 13 into elongated flexible segments 25 and 27 which project outwardly from the opposite ends of the tube 17. Similarly, the tube 17 divides the cord 15 into elongated flexible segments 29 and 31 which project outwardly from the opposite ends of the tube 17. Each of the segments 25,27,29, and 31 is resilient and has an outer end remote from the tube.

It is desirable to prevent relative nonresilient displacement between the cords 13 and 15. This is accomplished by attaching the cords 13 and 15 together. Although the attachment means may take many different forms, in the embodiment illustrated, it includes a clamp 33 constructed of a deformable metal such as wire wrapped around both of the cords 13 and 15. The clamp 33 is preferably located at the central regions of the cords 13 and 15. This permits the clamp 33 to be located within the passage 23 of the tube 17 so that the clamp is completely concealed. In any event, the clamp 33 attaches the central regions of the cord 13 and 15 together and prevents the cords from non-resiliently sliding relative to each other within the tube 17.

Figure 3:
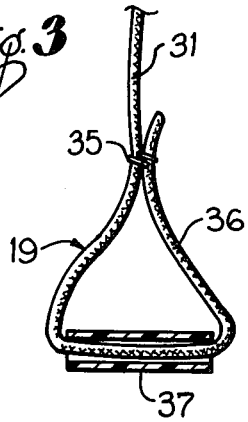
FIG. 3 is an enlarged view of one of the handles with a portion of the handle being shown in section.

One of the handles 19 is located at the outer end of each of the segments 25,27,29, and 31. The handles 19 may be of various different constructions and the construction shown in FIGS. 1 and 3 is purely illustrative. As shown in FIG. 3, an outer end portion of the segment 31 is formed into a loop 36 and attached to another region of the segment 31 in any suitable manner such as by a wire clamp 35. A rigid sleeve 37 of plastic slidably fits over a section of the loop 36. In the embodiment illustrated, the handles 19 are identical to each other and each of them is of generally triangular configuration as viewed in elevation. The sleeve 37 can be manually grasped or it may serve as the bottom of a stirrup when the handle 19 receives the foot of the user.

Although the cords 13 and 15 can be of different lengths in the embodiment illustrated, the cord 13 is shorter than the cord 15. Accordingly, the segments 25 and 27 are shorther than the segments 29 and 31. Preferably the segments 25 and 27 are of equal length. By way of example, and not by way of limitation, the tube 17 may be 12 to 14 inches in length, and each of the segments 25 and 27 may be from 16 to 20 inches in length as measured in the relaxed condition from the end of the tube 17 to the outer end of the handle 19. The corresponding dimension of the segments 29 and 31 may be, for example, 26 to 30 inches.

Figure 4:
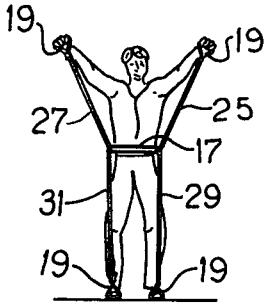
FIGS. 4 and 5 are operational views showing two illustrative ways in which the multi-purpose exerciser can be used.

The exerciser 11 is extremely versatile and can be used in a very large number of exercises. For example, as shown in FIG. 4, the feet of the user are received in the handles 19 formed on the ends of the segments 29 and 31, respectively and the hands of the user grasp the handles 19 of the segments 25 and 27. The arms and/or legs of the user can then be extended and retracted as desired against the resilient force of the segments 25–31.

Figure 5:
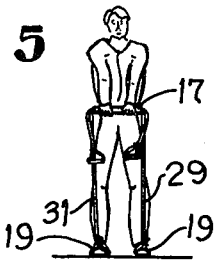

FIG. 5 shows by way of example one usage of the exerciser 11 in which the tube 17 is grasped. As shown in FIG. 5, the user places his feet in the handles 19 associated with the segments 29 and 31 and pulls repeatedly upwardly on tube 17. Many other exercises can be performed with the exerciser 11.

Although an exemplary embodiment of the invention has been shown and described, many changes, modifications and substitutions may be made by one having ordinary skill in the art without necessarily departing from the spirit and scope of this invention.

I claim:

1. A multi-purpose exerciser comprising:

first and second elongated flexible elements;

a tube means having a passage extending therethrough, said first and second elongated flexible elements extending through said passage of said tube means; said tube means being of sufficient length to permit manual grasping thereof during exercise, and said tube means holding intermediate sections of said first and second elongated flexible elements together throughout the entire length of the tube means said first elongated flexible element including first and second elongated, flexible segments projecting from opposite ends of said passage of said tube means, respectively;

said second elongated flexible element including third and fourth elongated, flexible segments projecting from opposite ends of said passage of said tube means, respectively;

each of said elongated flexible segments being resilient and having an outer end remote from said tube means; and means defining a handle on each of said elongated flexible segments adjacent the outer end thereof.

2. A multi-purpose exerciser as defined in claim 1 including means for attaching said first and second flexible elements together adjacent central regions thereof.

3. A multi-purpose exerciser as defined in claim 2 wherein said attaching means includes a member within said tube means and at least partially circumscribing said first and second flexible elements.

4. A multi-purpose exerciser as defined in claim 1 including means for frictionally resisting sliding of the tube means along the flexible elements.

5. a multi-purpose exerciser as defined in claim 4 wherein said resisting means includes the cross-sectional areas of said flexible elements being sufficiently large to frictionally engage the wall of said passage.

6. A multi-purpose exerciser as defined in claim 1 wherein said first flexible element is longer than said second flexible element.

7. A multi-purpose exerciser as defined in claim 6 including means for attaching said first and second flexible elements together adjacent central regions thereof and means for frictionally resisting sliding of the tube means along the flexible elements, said tube means being rigid.

8. A multi-purpose exerciser as defined in claim 7 wherein said attaching means includes a clamp within said tube means and said resisting means includes the cross-sectional areas of said flexible elements being sufficiently large to frictionally engage the wall of said passage.

9. A multi-purpose exerciser as defined in claim 1 wherein said tube means is rigid.

* * * * *